US011946654B2

(12) United States Patent
Stanley

(10) Patent No.: US 11,946,654 B2
(45) Date of Patent: Apr. 2, 2024

(54) BASEBOARD RADIATOR

(71) Applicant: SMITH'S ENVIRONMENTAL PRODUCTS LIMITED, South Woodham Ferrers (GB)

(72) Inventor: James Stanley, Basildon (GB)

(73) Assignee: Smith's Environmental Products Limited, Chelmsford (GB)

( * ) Notice: Subject to any disclaimer, the term of this patent is extended or adjusted under 35 U.S.C. 154(b) by 557 days.

(21) Appl. No.: 17/092,523

(22) Filed: Nov. 9, 2020

(65) Prior Publication Data

US 2022/0128243 A1 Apr. 28, 2022

(51) Int. Cl.

| | |
|---|---|
| ***F24D 10/00*** | (2022.01) |
| ***F24D 19/00*** | (2006.01) |
| ***F24D 19/02*** | (2006.01) |

(52) U.S. Cl.

CPC ..... *F24D 10/003* (2013.01); *F24D 19/0002* (2013.01); *F24D 19/0097* (2013.01); *F24D 19/0216* (2013.01)

(58) Field of Classification Search

CPC ..... F24D 10/003; F24D 19/0097; F24D 19/0002; F24D 19/04; F24D 19/0216

USPC ..... 237/70; 219/628, 520, 525; 208/42, 47

See application file for complete search history.

(56) References Cited

U.S. PATENT DOCUMENTS

| | | | | |
|---|---|---|---|---|
| 3,451,169 | A * | 6/1969 | Bell | F16B 5/121 52/716.8 |
| 6,550,688 | B1 | 4/2003 | Uglietto | |
| 2007/0175124 | A1* | 8/2007 | Webster | F24D 19/04 52/220.1 |

* cited by examiner

*Primary Examiner* — Steven B McAllister
*Assistant Examiner* — John E Bargero
(74) *Attorney, Agent, or Firm* — Renner, Kenner, Greive, Bobak, Taylor & Weber Co. LPA

(57) ABSTRACT

A baseboard radiator (10) for use in perimeter heating has a heating coil (11), a chassis (25) and a cover (23). The heating coil (11) has at least one fin (12), defining a front edge (13), a rear edge (14), an upper edge (15) and a lower edge (16) of the heating coil (11). The lower edge (16) has front (21) and rear (22) notches formed therein. The chassis (25) engages with the rear notch (22) and extends from the lower edge (16) over the rear edge (14) and the upper edge (15). The chassis (25) is further adapted for mounting the radiator (10) on a wall (28). The cover (23) engages with the front notch (21) and extends from the lower edge (16) over the front edge (13) and the upper edge (15) to engage between the chassis (25) and the wall (28).

12 Claims, 3 Drawing Sheets

BASEBOARD RADIATOR

FIELD OF INVENTION

This invention relates, in a first aspect thereof, to an improved baseboard radiator. In a second aspect thereof, the invention relates to a kit of parts for installation of an improved baseboard radiator according to the first aspect of the invention; and in a third aspect thereof, the invention relates to a method of installing an improved baseboard radiator according to the first aspect of the invention, using a kit of parts according to the second aspect of the invention.

BACKGROUND OF THE INVENTION

Baseboard radiators are adapted to be mounted on, or in place of, a baseboard provided around the lower part of an interior wall of a room. Baseboards are also known as skirting boards, and baseboard radiators are also sometimes referred to as skirting board radiators, perimeter heaters, or other variations of these terms.

Baseboard radiators can be heavy, bulky, and difficult to install. The radiator must be properly levelled during installation to ensure efficient flow of fluid within the pipes. The radiator must also be mounted with an air space above floor level to ensure adequate air circulation. The baseboard radiator will often be installed before the flooring is finished, and so this must be factored into the installation.

U.S. Pat. No. 6,550,688 describes a baseboard radiator having a heating coil which engages with a wall mounting bracket, which seeks to address some of these issues. The present invention seeks to provide a further improved baseboard radiator, which does not require a separate wall mounting bracket or clamp. The present invention also seeks further to facilitate the installation procedure for a baseboard radiator, and to improve the aesthetic presentation and acoustic performance of the radiator.

SUMMARY OF INVENTION

According to a first aspect of the present invention there is provided a radiator comprising:

- a heating coil having at least one fin, each said fin defining a front edge, a rear edge, an upper edge and a lower edge of said heating coil, and wherein said lower edge has front and rear notches formed therein;
- a chassis engaging with said rear notch and extending from said lower edge over the rear edge and the upper edge, said chassis being adapted for mounting on a wall; and
- a cover engaging with said front notch extending from said lower edge over the front edge and the upper edge, to engage with the chassis adjacent said upper edge.

The heating coil preferably comprises a plurality of aligned fins extending longitudinally along the length of the chassis. The length of the coil, the chassis and the cover may be varied to fit the dimensions of the wall on which the radiator is mounted. Alternatively, or additionally, the coil, the chassis and the cover may each be comprised of a plurality of adjoining sections, the number of said sections being varied to fit the dimensions of the wall. In this way, the radiator may be assembled to form an elongated baseboard radiator for perimeter heating.

The front and rear notches are preferably substantially V-shaped. Complementarily shaped tabs may be formed on the respective lower portions of the chassis and the cover, said tabs being adapted to engage with the V-shaped notches.

The cover preferably overlies the chassis at the upper edge of the heating coil, with the chassis in turn overlying the upper edge. The cover preferably has a return fold adapted to engage between the chassis and the wall on which the radiator is mounted, adjacent the upper edge of the heating coil.

The chassis is preferably provided with embossed mounting points adapted to receive screws or other fixing means, to mount the chassis on the wall. The embossed mounting points serve to space the chassis from the wall, thereby defining a gap adapted to accommodate the return fold of the cover. The embossed mounting points further enable the screw heads to be secured flush with the chassis, thus preventing fouling on the heating coil.

The radiator preferably further comprises at least one insulating clip arranged between the rear notch and the chassis and/or between the front notch and the cover. Preferably, plastic insulating clips are provided both between the rear notch and the chassis and between the front notch and the cover. The insulating clips act to prevent metal to metal contact, and so reduce vibrations and associated noise.

In embodiments where the radiator is an elongated baseboard radiator for perimeter heating, there are preferably further provided one or more joining strips provided over joins between adjacent sections of cover, thereby to conceal said joins. The joining strips may also be used during installation of the radiator, to hold the heating coil in place on the chassis, before the cover is attached, whilst adjacent sections of heating coil are interconnected. The joining strips may then be removed, and then reattached over the cover, once the cover is in place. The joining strips engage with the cover and preferably have a profile substantially corresponding to that of the cover. The joining strips may also each be provided with a complementarily shaped tab formed on the lower portion thereof, said tabs being adapted to engage with the V-shaped front notch of the heating coil.

The heating coil is preferably adapted for connection to a hydronic central heating system. In alternative embodiments, the radiator may however be adapted for use with other heat sources. In such embodiments, the heating coil may instead be, e.g. an electric heating element.

According to a second aspect of the present invention there is provided a kit of parts for installation of a radiator as hereinbefore described, comprising:

- a heating coil having a front edge, a rear edge, an upper edge and a lower edge, said lower edge having front and rear notches formed therein;
- a chassis adapted to engage with said rear notch thereby to extend from said lower edge over the rear edge and the upper edge, said chassis being further adapted for mounting on a wall;
- a cover adapted to engage with said front notch thereby to extend from said lower edge over the front edge and the upper edge, to engage with the chassis adjacent said upper edge; and mounting, assembly and connection means.

The mounting means preferably comprise screws adapted to be received in embossed mounting points formed in the chassis as hereinbefore described with reference to the first aspect of the invention.

In a preferred embodiment, the kit of parts is provided for installation of an elongated baseboard radiator for perimeter heating as hereinbefore described, and comprises a plurality of sections of heating coil and/or chassis and/or cover adapted to be assembled in adjoining arrangement.

The kit of parts preferably further comprises one or more joining strips adapted to be mounted over joins between adjacent sections of cover, thereby to conceal said joins.

According to a third aspect of the present invention there is provided a method for installing a radiator having a heating coil, a chassis and a cover as hereinbefore described, using a kit of parts also as hereinbefore described, comprising the steps of:

(a) mounting the chassis on a wall;

(b) engaging the heating coil with the chassis, via the rear notch formed on the lower edge of said heating coil; and (c) engaging the cover with the heating coil, via the front notch formed in the lower edge of said heating coil, and with the chassis adjacent the upper edge of the heating coil.

In a preferred embodiment, the method is provided for installing an elongated baseboard radiator for perimeter heating as hereinbefore described, using a kit of parts also as hereinbefore described, further comprising the additional sub-steps, between steps (b) and (c), of:

(i) engaging one more joining strips with the heating coil, via the front notch formed in the lower edge of said heating coil, and with the chassis adjacent the upper edge of the heating coil, thereby to retain the heating coil in place on the chassis;

(ii) interconnecting adjacent sections of heating coil; and (iii) disengaging the joining strips from the heating coil and chassis; and subsequently, after step (c), of:

(iv) re-engaging the joining strips over the cover, thereby to conceal joins between adjacent sections of cover.

Step (a) preferably comprises mounting the chassis to the wall via screws received in embossed mounting points formed in the chassis, as hereinbefore described with reference to the first aspect of the invention.

BRIEF DESCRIPTION OF THE DRAWINGS

In order that the present invention may be clearly understood, a preferred embodiment thereof will now be described in detail, though only by way of example, with reference to the accompanying drawings, in which.

DETAILED DESCRIPTION OF THE INVENTION

Figure 1:
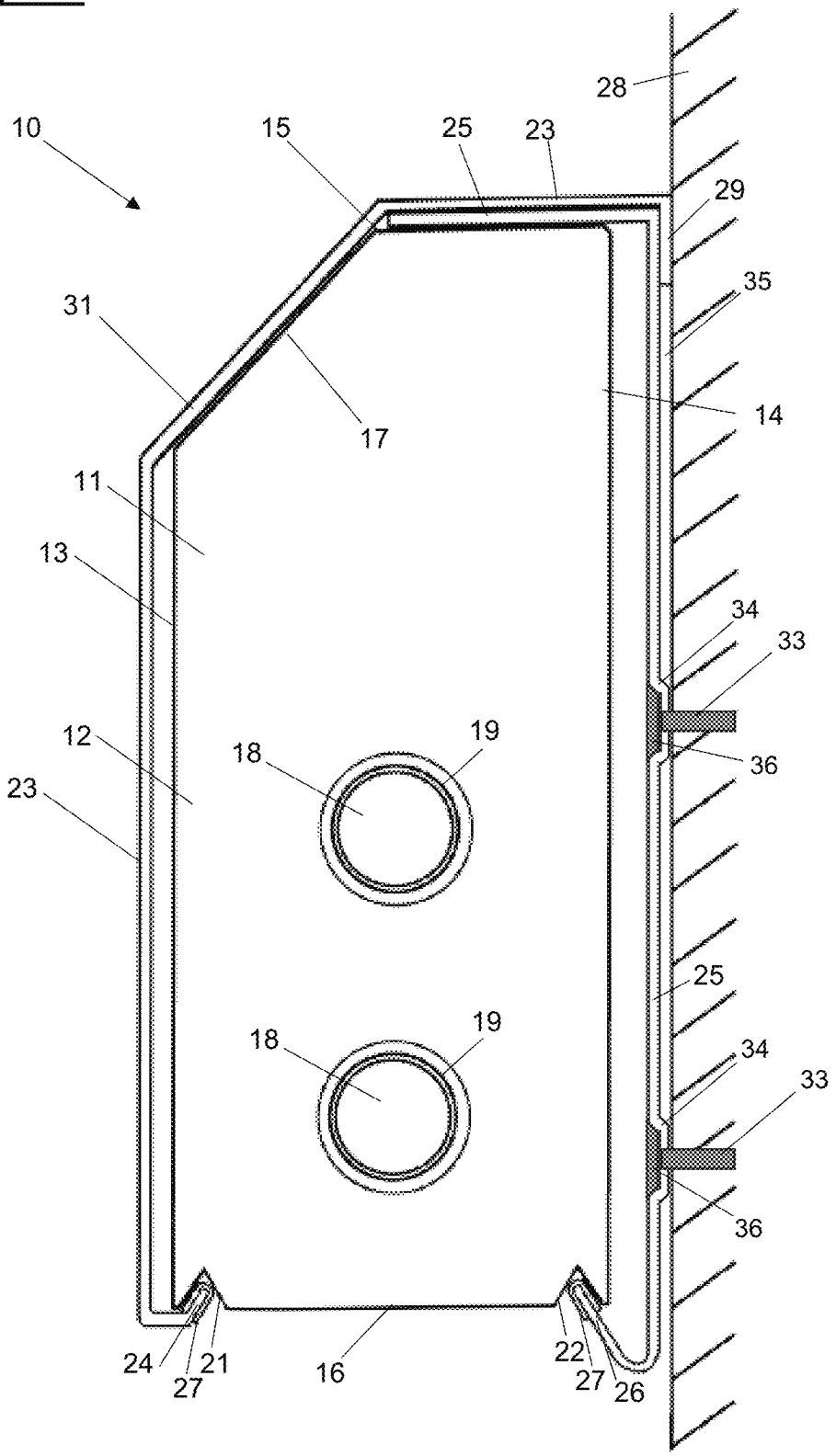
FIG. 1 is a cross-sectional end view of a radiator according to the present invention, mounted on a wall.

Referring first to FIG. 1, there is shown a baseboard radiator, generally indicated 10, according to a first aspect of the present invention. The radiator 10 has a heating coil 11, formed from a plurality of aligned fins 12, (as can best be seen in FIG. 2). Each fin 12 has a front edge 13, a rear edge 14, an upper edge 15, a lower edge 16, and an angled edge 17 formed between the front edge 13 and the upper edge 15. Said edges 12-17 also define the edges of the heating coil 11.

The heating coil 11 has conduits 18 passing through the fins 12, with connectors 19 to permit fluid connection to a hydronic central heating system (not shown).

Referring again to FIG. 1, the lower edge 16 of each fin 12 has formed therein front and rear V-shaped notches 21, 22. The front notch 21 engages with a front cover 23 of the radiator 10 via a complimentarily shaped tab 24 formed at the bottom of the cover 23. The rear notch 22 engages with a chassis 25 of the radiator 10, also via a complimentarily shaped tab 26 formed at the bottom of the chassis 25. Both tabs 24, 26 are provided with plastic insulating clips 27, to prevent metal to metal contact between the heating coil 11 and the cover 23 or chassis 25, and so reduce vibrations and associated noise.

The radiator 10 is mounted on a wall 28 via screws 33 received in embossed mounting points 34 formed in the chassis 25. The embossed mounting points 34 serve to space the chassis 24 from the wall 28, thus defining a gap 35 therebetween. The embossed mounting points 34 further serve to enable the screw heads 36 to be secured flush with the chassis 25 thus preventing fouling on the heating coil 11.

The chassis 25 extends from the rear notch 22 in the lower edge 16 of the heating coil 11, over the rear edge 14 and the upper edge 15. The cover 23 extends from the front notch 21 in the lower edge 16 of the heating coil 11, over the front edge 13, and the upper edge 15, where it overlies the chassis 25. The cover 23 terminates in a return fold 29 which engages between the chassis 25 and the wall 28, accommodated in the gap 35 therebetween. A grille panel 31 is provided in the cover 23 (as can best be seen in FIG. 3), overlying the angled edge 17 of the heating coil 11, to allow warmed air to exit the radiator 10.

Figure 2:
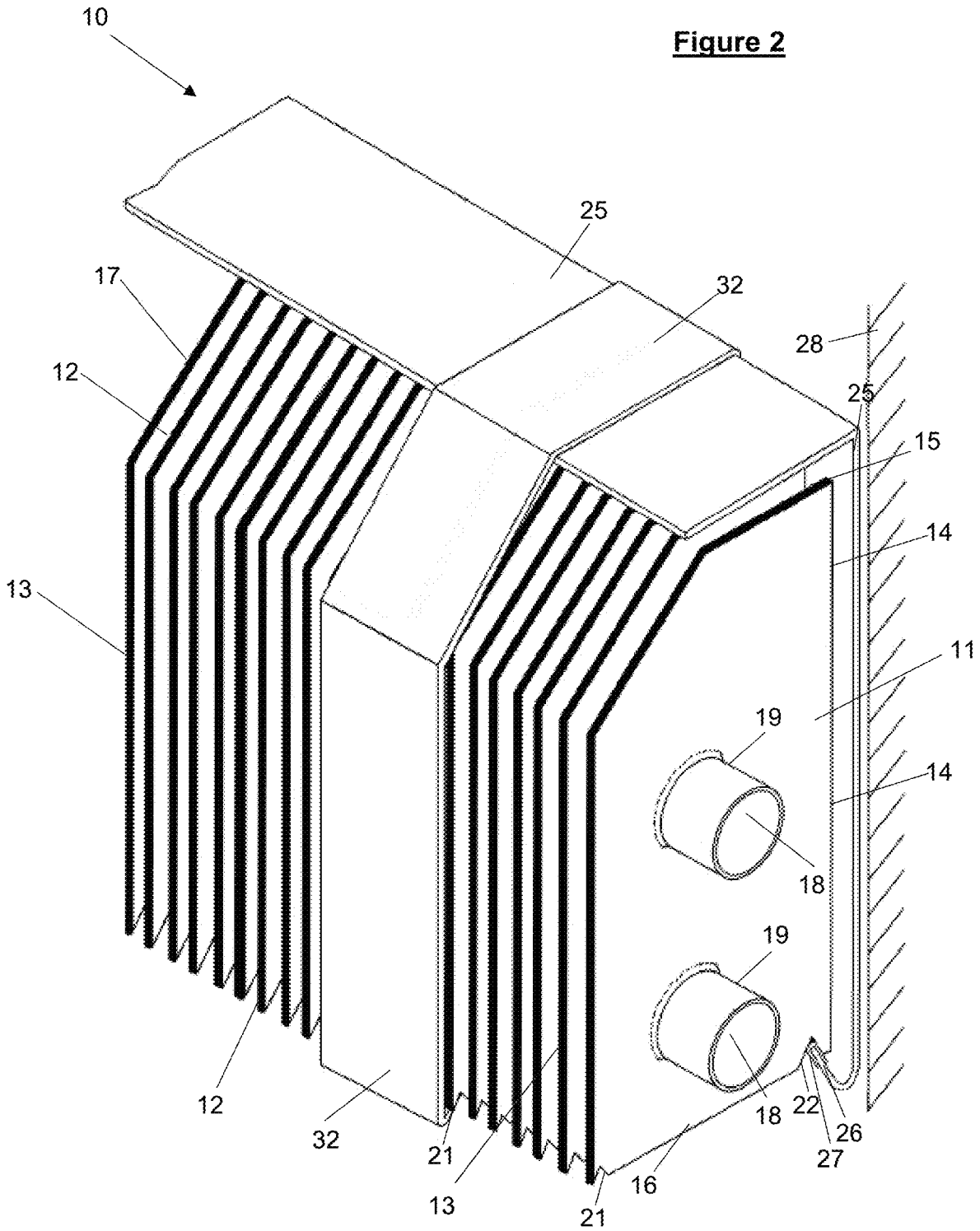
FIG. 2 is a perspective view of the radiator of FIG. 1, without the cover, during the installation procedure.
Figure 3:
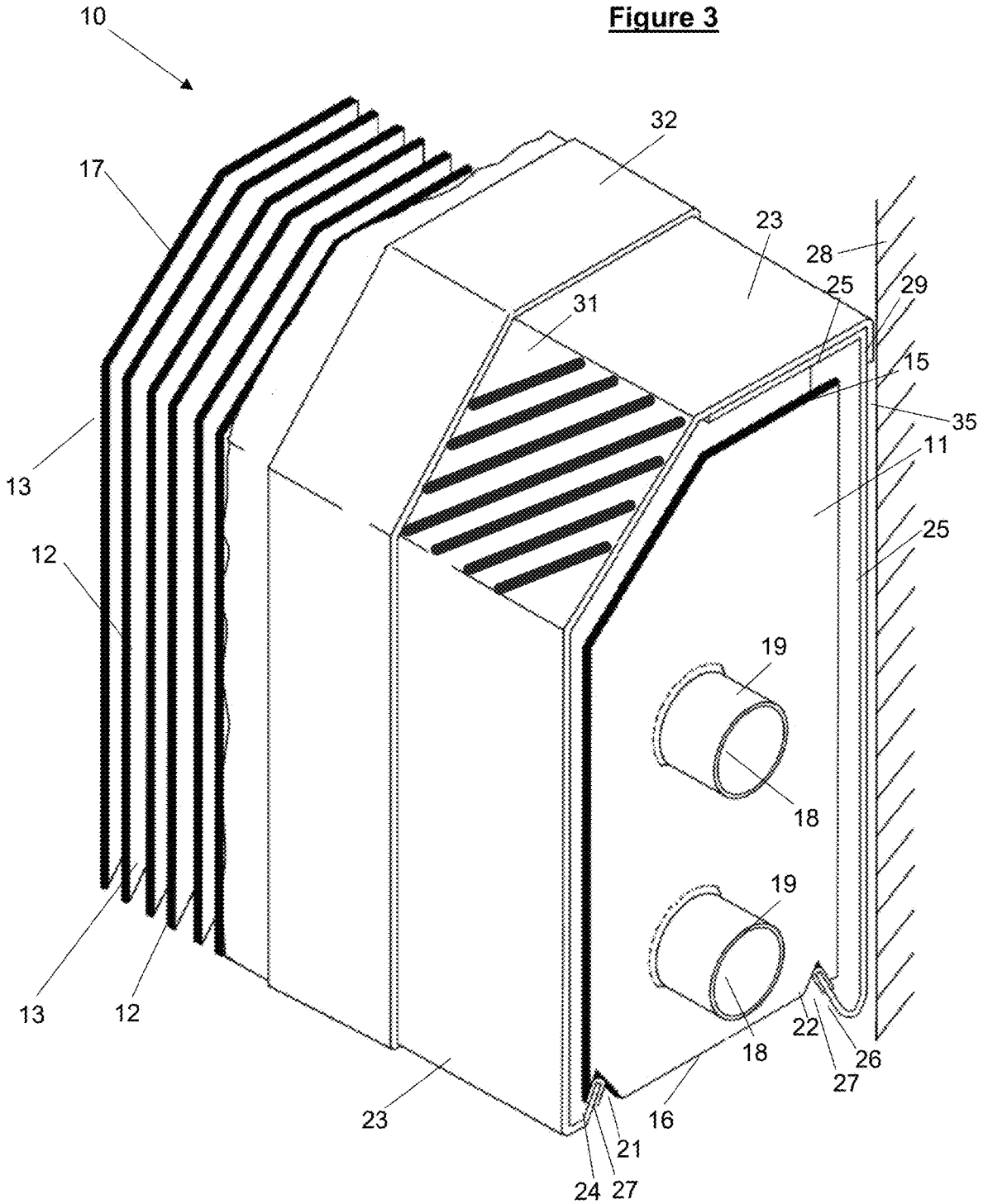
FIG. 3 is a perspective view of the radiator of FIG. 2, with the cover in place.

Referring now to FIGS. 2 and 3, the radiator 10 is provided with joining strips 32. When the radiator 10 is full assembled and installed, as shown in FIG. 3, the joining strips 32 fit over the cover 23 and serve to conceal the joins between adjacent sections of cover 23. This is particularly beneficial where the radiator 10 forms an elongated baseboard radiator for perimeter heating, and so is comprised of multiple adjoining sections of heating coil 11, cover 23 and chassis 25.

The joining strips 32 are also utilised during the installation process according to the third aspect of the present invention, as will now be described with reference to FIGS. 1, 2 and 3.

In the installation process, the chassis 25 is first mounted on the wall 28, via screws 33 located in embossed mounting points 34. Sections of heating coil 11 are then engaged with the chassis 25, via the rear notch 22 formed in the lower edge 16 of the heating coil 11. Joining strips 32 are then engaged with the heating coil 11, via the front notch 21 formed in the lower edge 16 of the heating coil 11, as shown in FIG. 2. The joining strips 32 also engage with the chassis 25 adjacent the upper edge 15 of the heating coil 11.

The joining strips 32 retain the heating coil 11 in place on the chassis 25, whilst adjacent sections of heating coil 11 are interconnected. Once this is done, the joining strips 32 can then be disengaged and removed from the heating coil 11 and chassis 25.

Sections of cover 23 are then engaged with the heating coil 11, via the front notch 21 formed in the lower edge 16 of the heating coil 11, and with the chassis 25, via the return fold 29 of the cover engaging in the gap 35 between the chassis 25 and the wall 28, as shown in FIG. 3. The joining strips 32 can now be re-engaged over the cover 23, thereby to conceal joins between adjacent sections of cover 23, as also shown in FIG. 3.

The invention claimed is:

1. A method for installing an elongated baseboard radiator having a plurality of adjoining sections of heating coil, a plurality of adjoining sections of chassis, a plurality of adjoining sections of cover, and one or more joining strips, comprising the steps of: (a) mounting a section of chassis on a wall; (b) engaging a section of heating coil with the section of chassis, via a rear notch formed on a lower edge of said section of heating coil; (i) engaging a joining strip with said section of heating coil, via a front notch formed in said lower edge of said section of heating coil, and with said section of chassis adjacent an upper edge of said section of heating coil, thereby to retain said section of heating coil in place on said section of chassis; (ii) interconnecting an adjacent section of heating coil with said section of heating coil; (iii) disengaging said joining strip from the heating coil and chassis; (c) engaging a section of cover with the section of heating coil, via the front notch formed in the lower edge of said section of heating coil, and with the section of chassis adjacent an upper edge of the section of heating coil; and (i) re-engaging the joining strip over the cover, thereby to conceal joints between adjacent sections of cover.

2. The method as claimed in claim 1, wherein step (a) comprises mounting the section of chassis to the wall via screws received in embossed mounting points formed in the section of chassis.

3. An elongate baseboard radiator for perimeter heating comprising:

a plurality of adjoining sections of heating coil having at least one fin, each said fin defining a front edge, a rear edge, an upper edge and a lower edge of said heating coil, and wherein said lower edge has front and rear notches formed therein;

a plurality of adjoining sections of chassis engaging with said rear notch and extending from said lower edge over the rear edge and the upper edge, said chassis being adapted for mounting on a wall;

a plurality of adjoining sections of cover engaging with said front notch extending from said lower edge over the front edge and the upper edge, to engage with the chassis adjacent said upper edge; and one or more joining strips provided over joints between adjacent sections of cover, thereby to conceal said joints, said one or more joining strips engaging with the cover and having a profile substantially corresponding to that of the cover; said elongate baseboard radiator having been installed by the method of claim 1.

4. An elongated baseboard radiator as claimed in claim 3, wherein the heating coil comprises a plurality of aligned fins extending longitudinally along the chassis.

5. An elongated baseboard radiator as claimed in claim 3, wherein said front and rear notches are substantially V-shaped.

6. An elongated baseboard radiator as claimed in claim 3, wherein the cover overlies the chassis at said upper edge, and has a return fold adapted to engage between the chassis and said wall.

7. An elongated baseboard radiator as claimed in claim 3, wherein the chassis is provided with embossed mounting points adapted to receive screws or other fixing means, to mount the chassis to said wall.

8. An elongated baseboard radiator as claimed in claim 7, wherein the cover overlies the chassis at said upper edge, and has a return fold adapted to engage between the chassis and a said wall, and wherein the embossed mounting points serve to space the chassis from said wall, thereby defining a gap adapted to receive the return fold of the cover.

9. An elongated baseboard radiator as claimed in claim 3, further comprising at least one insulating clip arranged between the rear notch and the chassis and/or between the front notch and the cover.

10. An elongated baseboard radiator as claimed in claim 3, wherein the heating coil is adapted for connection to a hydronic central heating system.

11. A kit of parts for installation of an elongated baseboard radiator according to the method of claim 1 comprising:

a plurality of sections of heating coil each having a front edge, a rear edge, an upper edge and a lower edge, said lower edge having front and rear notches formed therein;

a plurality of sections of chassis each adapted to engage with said rear notch thereby to extend from said lower edge over the rear edge and the upper edge, said chassis being further adapted for mounting on a wall;

a plurality of sections of cover each adapted to engage with said front notch thereby to extend from said lower edge over the front edge and the upper edge, to engage with the chassis adjacent said upper edge; and one or more joining strips each having a profile substantially corresponding to that of the cover and being adapted to engage with the cover and over joints between adjacent sections of cover, thereby to conceal said joints;

said kit of parts further comprising mounting, assembly and connection means.

12. A kit of parts as claimed in claim 11, wherein the mounting means comprise screws adapted to be received in embossed mounting points formed in the chassis.

* * * * *